US007491157B1

(12) United States Patent
Lin

(10) Patent No.: US 7,491,157 B1
(45) Date of Patent: Feb. 17, 2009

(54) WEIGHT-ADJUSTABLE DUMBBELL

(75) Inventor: William Lin, Taichung (TW)

(73) Assignee: Asia Regent Limited, Taichung (TW)

( * ) Notice: Subject to any disclaimer, the term of this patent is extended or adjusted under 35 U.S.C. 154(b) by 0 days.

(21) Appl. No.: 12/041,335

(22) Filed: Mar. 3, 2008

(51) Int. Cl.
*A63B 21/075* (2006.01)

(52) U.S. Cl. ..... 482/108; 482/98; 482/107

(58) Field of Classification Search ..... 482/50, 482/92–94, 98, 99, 106–110; 473/256, 437
See application file for complete search history.

(56) References Cited

U.S. PATENT DOCUMENTS

| | | | | |
|---|---|---|---|---|
| 295,429 | A * | 3/1884 | Reach | 482/109 |
| 1,044,018 | A * | 11/1912 | Calvert | 482/108 |
| 1,138,196 | A * | 5/1915 | Diehl | 482/106 |
| 1,316,683 | A * | 9/1919 | Calvert | 482/93 |
| 1,422,888 | A * | 7/1922 | Reeves | 482/93 |
| 1,917,566 | A * | 7/1933 | Wood | 482/108 |
| 4,431,185 | A * | 2/1984 | Cisneros | 482/93 |
| 5,299,999 | A * | 4/1994 | Brine | 482/105 |
| 6,387,022 | B1 * | 5/2002 | Smith | 482/106 |
| 6,896,645 | B1 * | 5/2005 | Krull | 482/107 |
| 7,052,445 | B2 * | 5/2006 | Ekhaus | 482/93 |
| 7,097,601 | B1 * | 8/2006 | Ronnow | 482/106 |
| 7,182,715 | B2 * | 2/2007 | Anderson | 482/93 |
| 7,381,157 | B2 * | 6/2008 | Blateri | 482/50 |
| 2005/0245369 | A1 * | 11/2005 | Vigiano | 482/94 |
| 2006/0234843 | A1 * | 10/2006 | Chen | 482/107 |
| 2008/0081744 | A1 * | 4/2008 | Gormley | 482/93 |

FOREIGN PATENT DOCUMENTS

| | | | |
|---|---|---|---|
| JP | 2007021123 | A * | 2/2007 |
| WO | WO 2008/057368 | A2 * | 5/2008 |

* cited by examiner

*Primary Examiner*—Loan H Thanh
*Assistant Examiner*—Victor K Hwang
(74) *Attorney, Agent, or Firm*—Darby & Darby P.C.

(57) ABSTRACT

A weight-adjustable dumbbell includes a dumbbell shell unit, a weight unit, and an insert pin unit. The dumbbell shell unit includes a shell body confining a receiving space, and a weight selector rod connected to the shell body, extending into the receiving space, and formed with through holes registered with insert holes in the shell body. The weight unit is extended removably into the receiving space via an open bottom of the shell body, and includes a base member provided with two positioning posts, and weight pieces stacked on the base member. Each weight piece is formed with a rod hole for extension of the weight selector rod, and two post holes for extension of the positioning posts. The insert pin unit includes an insert pin inserted removably into a selected insert hole and extending removably through a corresponding through hole in the weight selector rod.

9 Claims, 7 Drawing Sheets

WEIGHT-ADJUSTABLE DUMBBELL

BACKGROUND OF THE INVENTION

1. Field of the Invention

The invention relates to a dumbbell, more particularly to a weight-adjustable dumbbell.

2. Description of the Related Art

Referring to FIG. 1, a conventional weight-adjustable dumbbell 20 is shown to include a plurality of weight pieces 21, a handle 22 disposed above the weight pieces 21, a base plate 23 disposed below the weight pieces 21, a fastener 24, and a plurality of spacers 25. Each of the weight pieces 21 has a predetermined weight and is formed with a central hole 211. The handle 22 includes a grip portion 221 and a weight-coupling portion 222 connected to the grip portion 221. The weight-coupling portion 222 extends through the central holes 211 in the weight pieces 21, and is fastened to the base plate 23 via the fastener 24 that engages a screw hole 223 in the weight-coupling portion 222, thus securing the weight pieces 21 between the handle 22 and the base plate 23. To adjust the weight of the dumbbell 20, the fastener 24 must be loosened before replacement of the weight pieces 21 can be conducted. The weight-adjusting operation is thus inconvenient and time-consuming.

SUMMARY OF THE INVENTION

Therefore, an object of the present invention is to provide a weight-adjustable dumbbell that is convenient to use.

Accordingly, a weight-adjustable dumbbell of the present invention comprises a dumbbell shell unit, a weight unit, and an insert pin unit.

The dumbbell shell unit includes a hollow shell body, a weight selector rod, and a handle. The shell body confines a receiving space, and has a top shell portion with an inner side that faces the receiving space, and an outer side opposite to the inner side. The shell body further has an open bottom shell portion opposite to the top shell portion in a vertical direction. The weight selector rod has a top rod end connected to the top shell portion, extends downwardly from the inner side of the top shell portion into the receiving space of the shell body, and is formed with a plurality of through holes spaced apart from each other in the vertical direction. The shell body is formed with a plurality of insert holes, each of which is registered with a respective one of the through holes in the weight selector rod. The handle is connected to the outer side of the top shell portion.

The weight unit is extended removably into the receiving space via the bottom shell portion of the shell body, and includes a base member provided with a pair of upwardly extending positioning posts, and a plurality of weight pieces stacked on the base member. Each of the weight pieces has top and bottom sides, a rod hole formed through the top and bottom sides for extension of the weight selector rod, and a pair of post holes formed through the top and bottom sides for extension of the positioning posts, respectively. The bottom side of each of the weight pieces is formed with a first slot registered with a corresponding one of the through holes in the weight selector rod and a corresponding one of the insert holes in the shell body.

The insert pin unit includes an insert pin inserted removably into a selected one of the insert holes in the shell body, extending along the first slot in the bottom side of one of the weight pieces corresponding to the selected one of the insert holes, and extending removably through one of the through holes in the weight selector rod corresponding to the selected one of the insert holes such that, when the dumbbell shell unit is lifted relative to the base member, said one of the weight pieces is moved together with any other of the weight pieces disposed thereabove and the shell body away from the base member.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
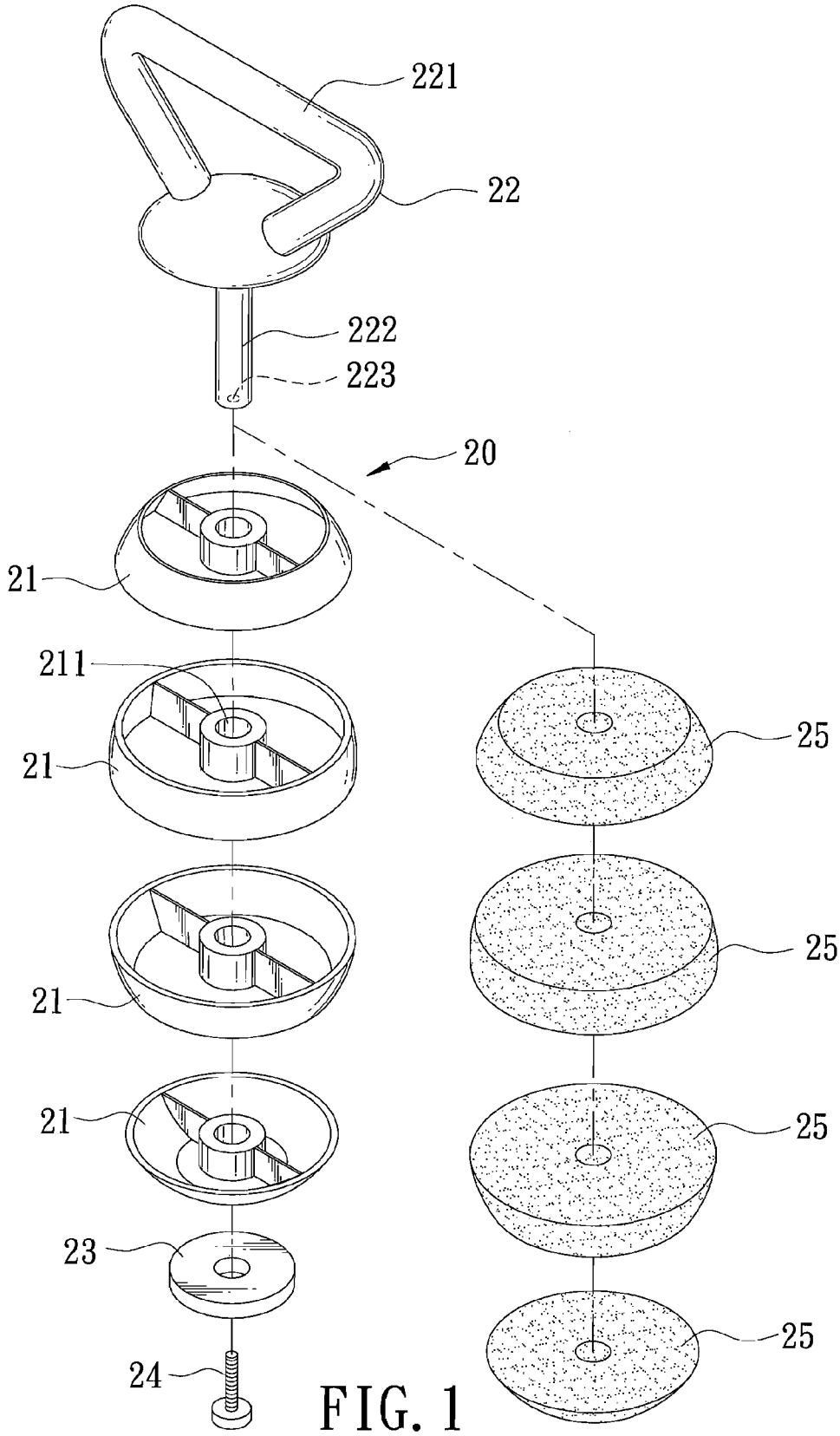
FIG. 1 PRIOR ART
FIG. 1 is an exploded perspective view of a conventional weight-adjustable dumbbell.
Figure 2:
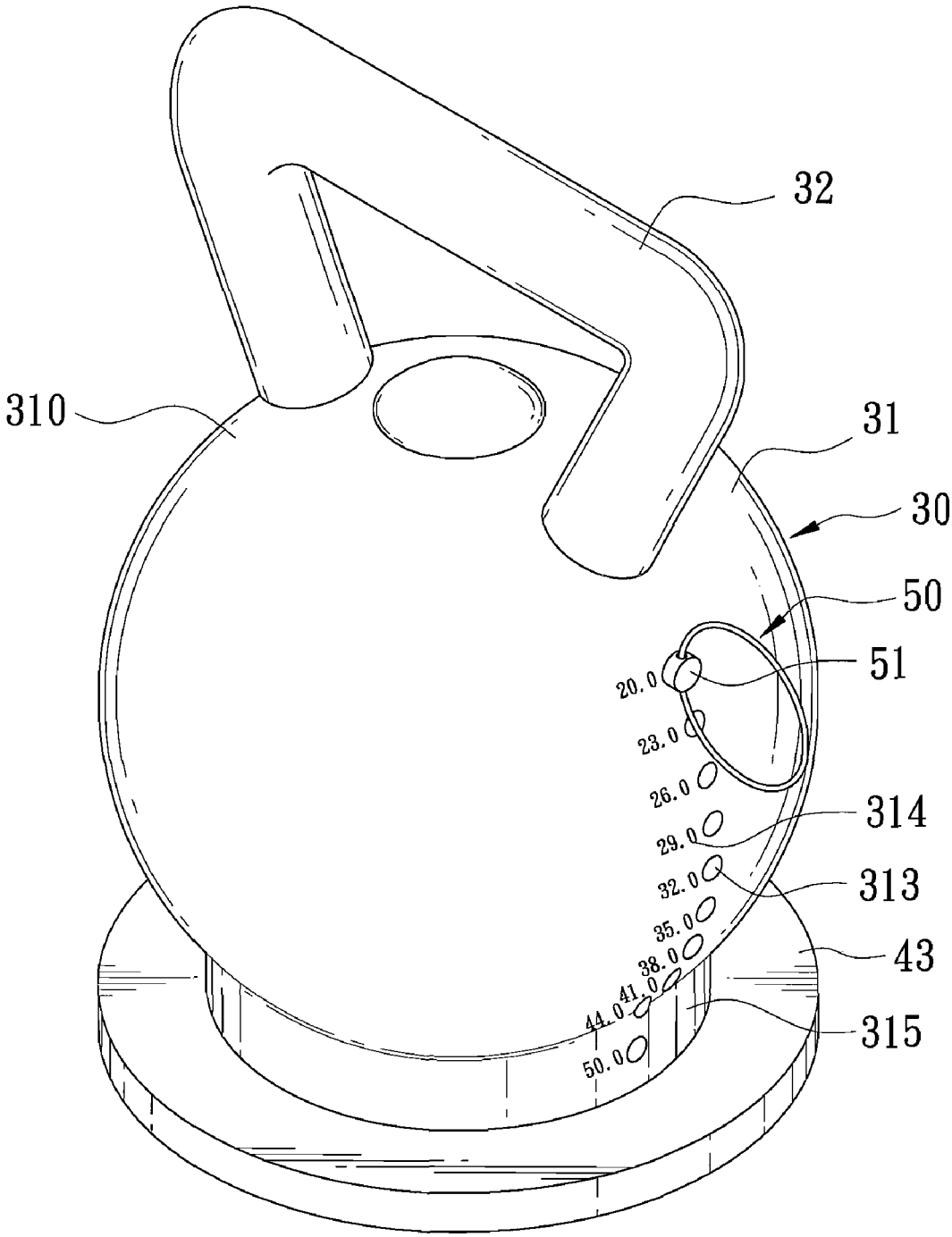
FIG. 2 is an assembled perspective view of the preferred embodiment of a weight-adjustable dumbbell according to the present invention.
Figure 3:
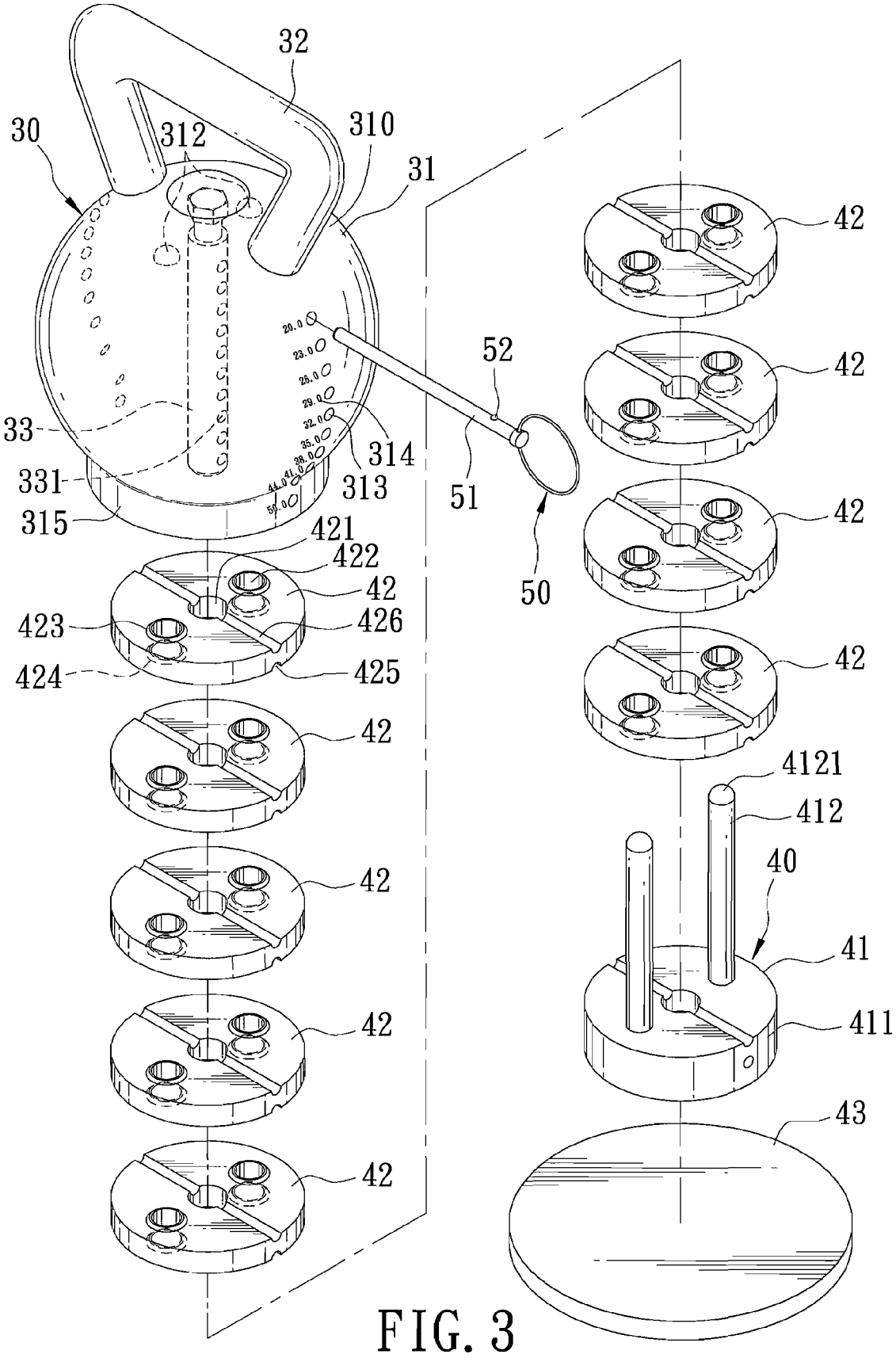
FIG. 3 is an exploded perspective view of the preferred embodiment.
Figure 4:
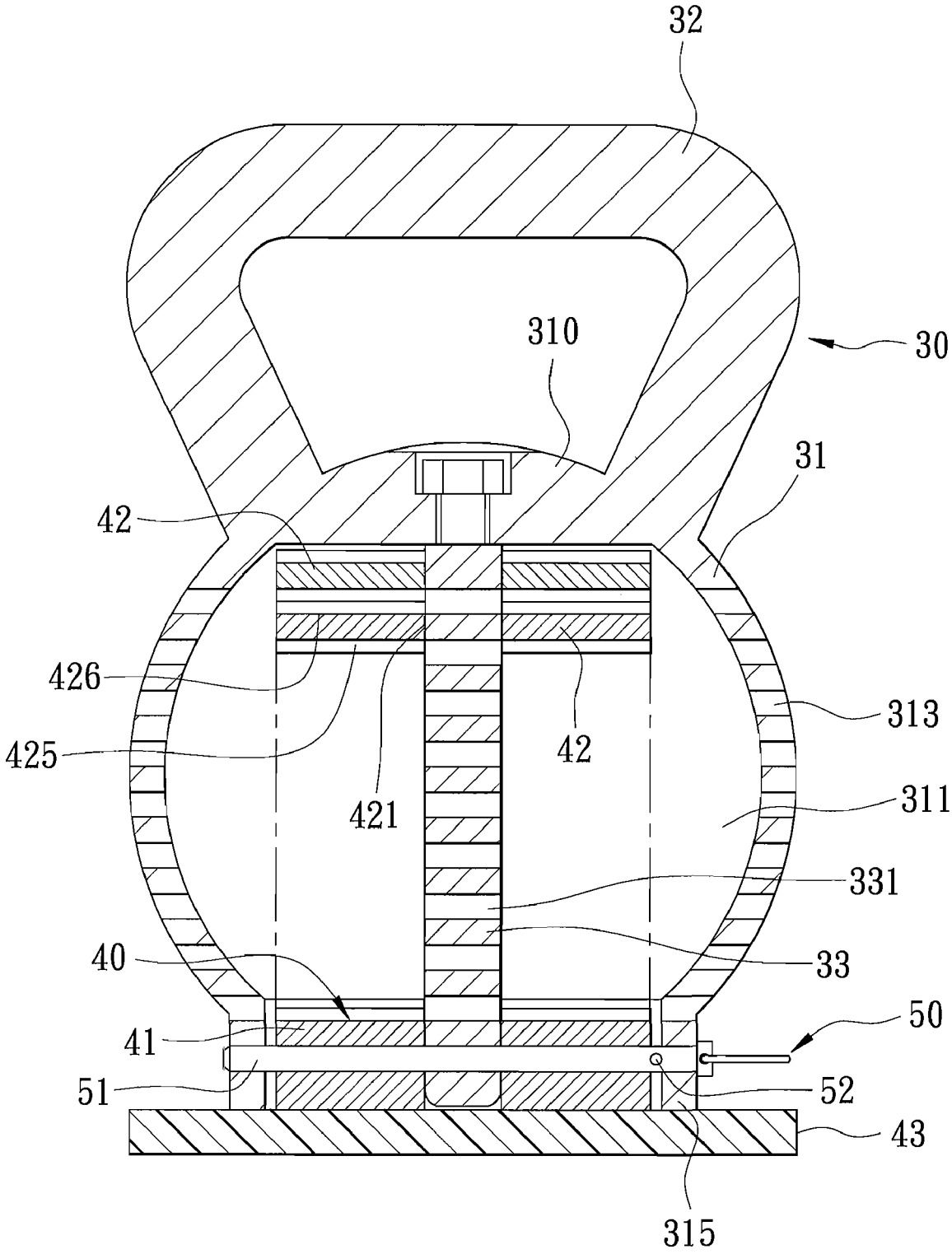
FIGS. 4 and 5 are sectional views of the preferred embodiment.

Referring to FIGS. 2 to 4, the preferred embodiment of a weight-adjustable dumbbell according to the present invention is shown to include a dumbbell shell unit 30, a weight unit 40, and an insert pin unit 50.

The dumbbell shell unit 30 includes a hollow shell body 31, a weight selector rod 33, and a handle 32. The shell body 31 confines a receiving space 311, and has a top shell portion 310 with an inner side that faces the receiving space 311, and an outer side opposite to the inner side. The shell body 31 further has an open bottom shell portion 315 opposite to the top shell portion 310 in a vertical direction. The weight selector rod 33 has a top rod end connected to the top shell portion 310, extends downwardly from the inner side of the top shell portion 310 into the receiving space 311 of the shell body 31, and is formed with a plurality of through holes 331 spaced apart from each other in the vertical direction. The shell body 31 is formed with a plurality of insert holes 313, each of which is registered with a respective one of the through holes 331 in the weight selector rod 33. The handle 32 is connected to the outer side of the top shell portion 310.

In this embodiment, the shell body 31 is generally ball-shaped, and the handle 32 has opposite ends connected to the shell body 31, thereby configuring the dumbbell shell unit 30 with a kettle-like appearance. In addition, the shell body 31 has an outer surface printed with weight indicia 314 at positions corresponding to the insert holes 313.

Figure 5:
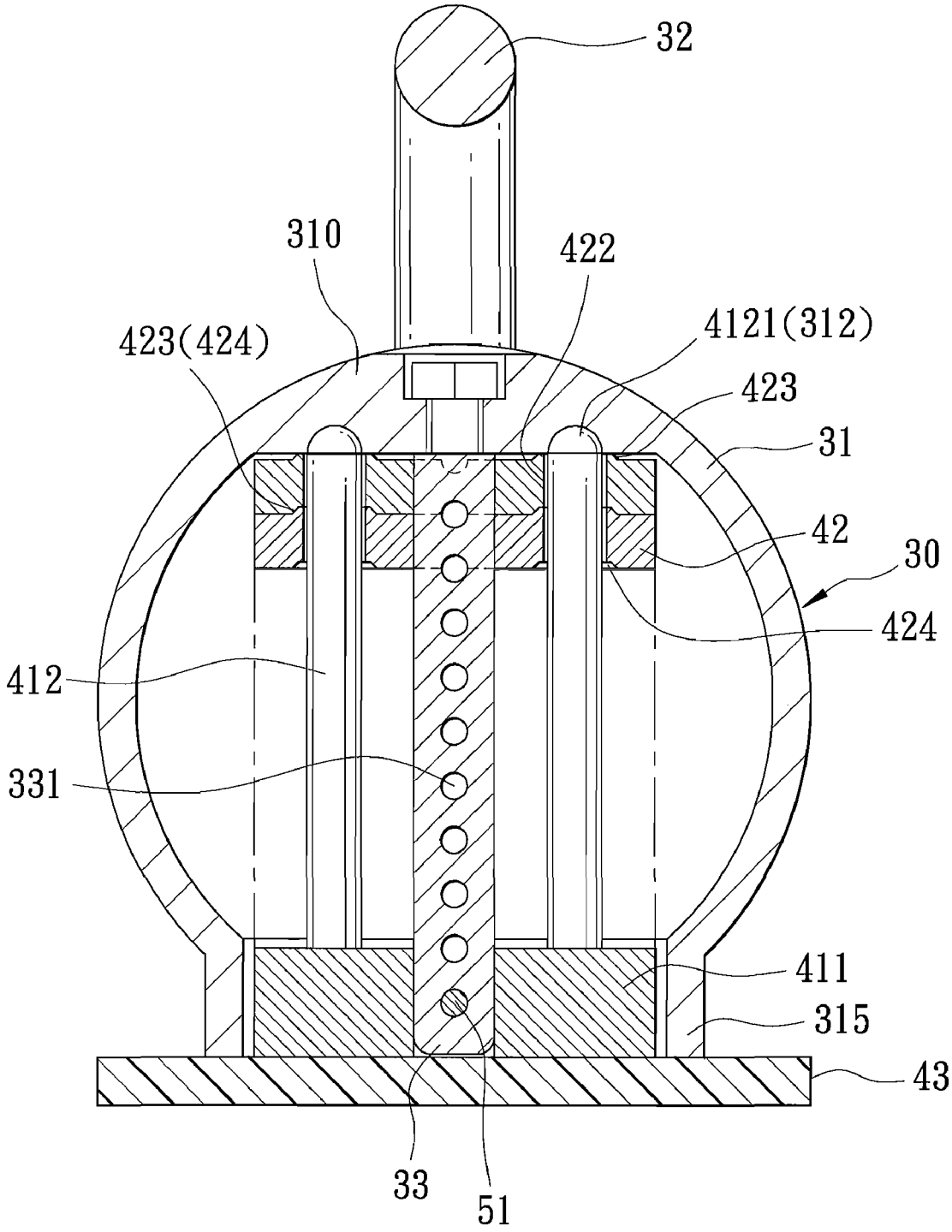

The weight unit 40 is extended removably into the receiving space 311 via the bottom shell portion 315 of the shell body 31, and includes a base member 41 provided with a pair of upwardly extending positioning posts 412, a plurality of weight pieces 42 stacked on the base member 41, and a buffer pad 43 disposed below the base member 41. In this embodiment, the base member 41 includes a base block 411 from which the positioning posts 412 extend. The base block 411 is thicker than the weight pieces 42. Preferably, the inner side of the top shell portion 310 of the shell body 31 is formed with a pair of positioning grooves 312, and each of the positioning posts 412 has a top end part 4121 removably extended into a respective one of the positioning grooves 312. In this embodiment, the top end part 4121 of each of the positioning posts 412 is dome-shaped to facilitate engagement with the positioning grooves 312 so as to ensure fast relative positioning between the shell body 31 and the base member 41. With additional reference to FIG. 5, each of the weight pieces 42 is a circular disc with a predetermined weight, and has top and bottom sides, a rod hole 421 formed through the top and bottom sides for extension of the weight selector rod 33, and a pair of post holes 422 formed through the top and bottom sides for extension of the positioning posts 412, respectively. The bottom side of each of the weight pieces 42 is formed with a first slot 425 registered with a corresponding one of the through holes 331 in the weight selector rod 33 and a corresponding one of the insert holes 313 in the shell body 31. In this embodiment, the top side of each of the weight pieces 42 is formed with a second slot 426 parallel to the first slot 425. The first slot 425 in an upper one of the weight pieces 42 cooperates with the second slot 426 in a lower one of the weight pieces 42 to form a straight passage for the insert pin unit 50 between the corresponding through hole 331 and the corresponding insert hole 313. In this embodiment, the top side of each of the weight pieces 42 is provided with a pair of wedge-shaped guide flanges 423 each disposed around a respective one of the post holes 422, and the bottom side of each of the weight pieces 42 is provided with a pair of guide recesses 424 each disposed around a respective one of the post holes 422. The guide recesses 424 in an upper one of the weight pieces 42 receive the guide flanges 423 of a lower one of the weight pieces 42 and guide extension of the positioning posts 412 through the post holes 422.

The insert pin unit 50 includes an insert pin 51 provided with a spring-loaded tumbler 52. The insert pin 51 is inserted removably into a selected one of the insert holes 313 in the shell body 31, extends along the first slot 425 in the bottom side of one of the weight pieces 42 corresponding to the selected one of the insert holes 313, and extends removably through one of the through holes 331 in the weight selector rod 33 corresponding to the selected one of the insert holes 313 such that, when the dumbbell shell unit 30 is lifted relative to the base member 41, said one of the weight pieces 42 is moved together with any other of the weight pieces 42 disposed thereabove and the shell body 31 away from the base member 41 (see FIG. 6). In this embodiment, the tumbler 52 is constituted by a steel ball and a spring, and serves to abut against the interior of the shell body 31 to prevent undesired removal of the insert pin 51 from the dumbbell shell unit 30.

Figure 6:
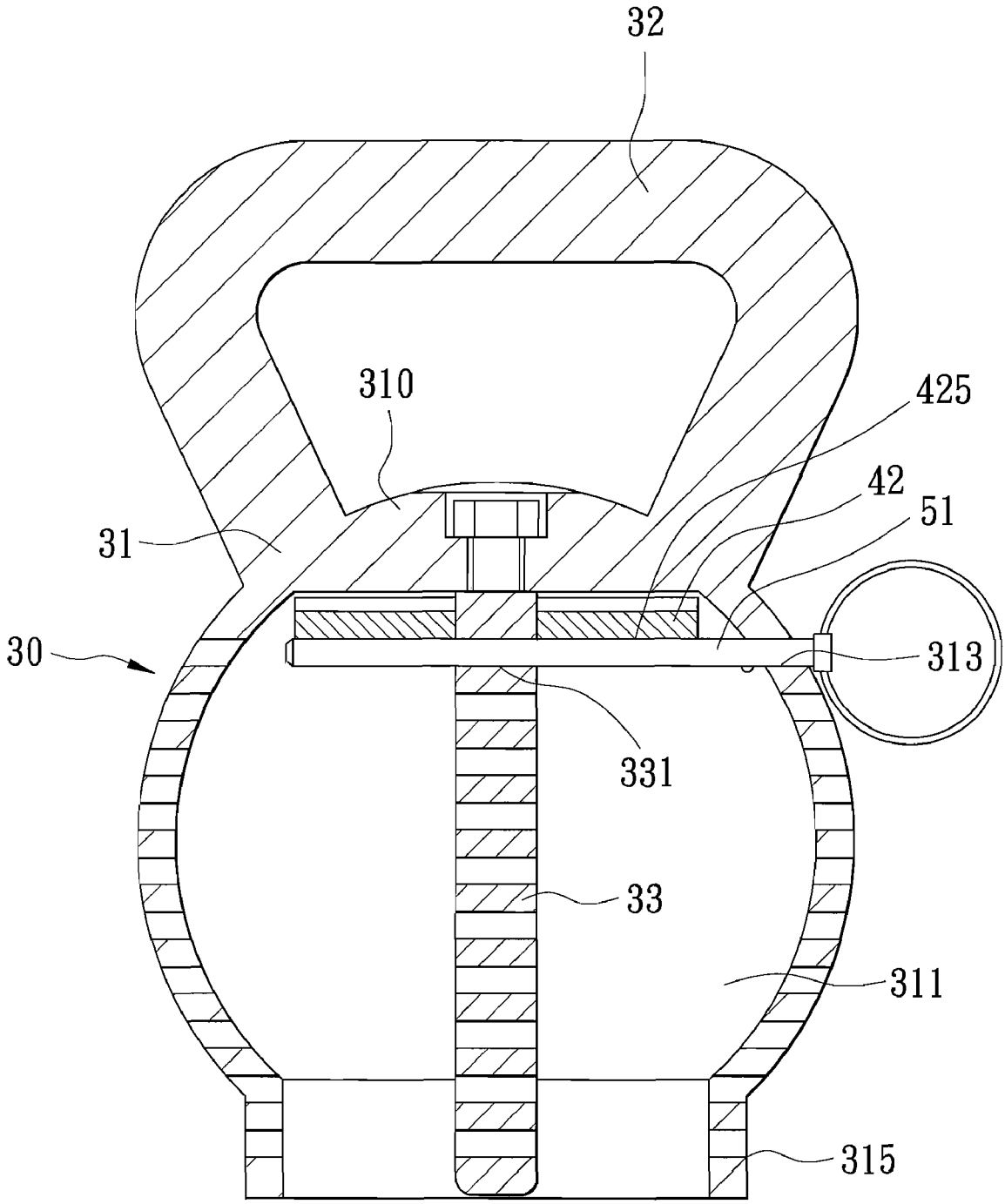
FIG. 6 is a sectional view to illustrate the preferred embodiment when configured for a lighter exercise load.

Referring to FIG. 6, when configuring the dumbbell of the preferred embodiment for a lighter exercise load, the insert pin 51 is inserted into one of the insert holes 313 marked with smaller weight indicia 314. At this time, the insert pin 51 extends along the first slot 425 in the corresponding weight piece 42 and through the corresponding through hole 331 in the weight selector rod 33. Therefore, the corresponding weight piece 42 is moved together with any other of the weight pieces 42 disposed thereabove and the shell body 31 away from the base member 41 when the dumbbell shell unit 30 is lifted relative to the base member 41 for weight training.

Figure 7:
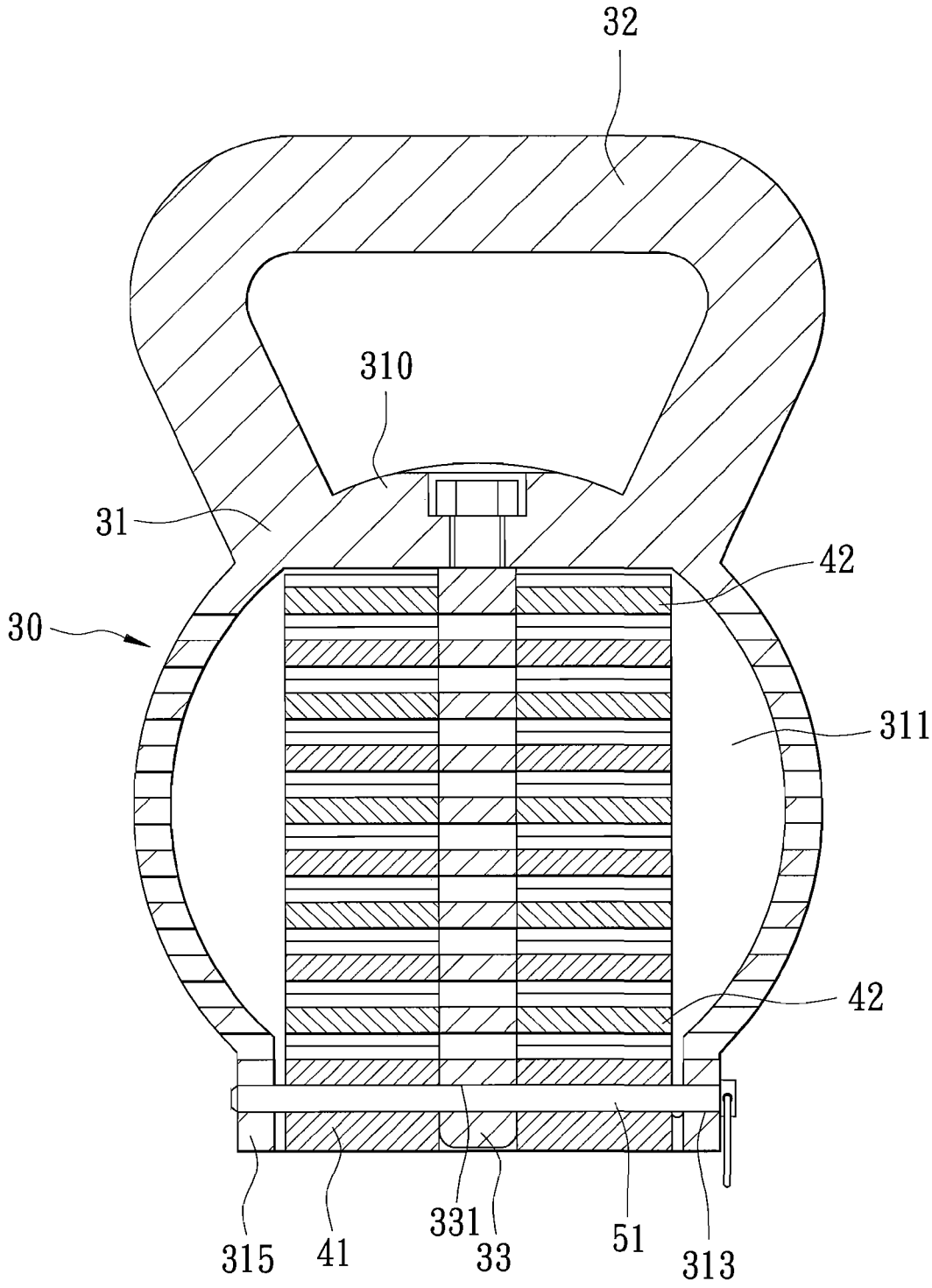
FIG. 7 is another sectional view to illustrate the preferred embodiment when configured for a heavier exercise load.

Referring to FIG. 7, when configuring the dumbbell of the preferred embodiment for a heavier exercise load, the insert pin 51 can be inserted into the insert hole 313 marked with the largest weight indicium 314. At this time, the insert pin 51 extends through the base member 41 of the weight unit 40 and the corresponding through hole 331 in the weight selector rod 33. Therefore, the base member 41 is moved together with the weight pieces 42 stacked thereon and the shell body 31 when the dumbbell shell unit 30 is lifted for weight training.

In sum, weight adjustment is conducted in the dumbbell of the present invention by simply inserting the insert pin 51 of the insert pin unit 50 into a selected insert hole 313 in the shell body 31 of the dumbbell shell unit 30.

While the present invention has been described in connection with what is considered the most practical and preferred embodiment, it is understood that this invention is not limited to the disclosed embodiment but is intended to cover various arrangement included within the spirit and scope of the broadest interpretation so as to encompass all such modifications and equivalent arrangements.

What is claimed is:

1. A weight-adjustable dumbbell comprising:

a dumbbell shell unit including a hollow shell body confining a receiving space, and having a top shell portion with an inner side that faces said receiving space, and an outer side opposite to said inner side, said shell body further having an open bottom shell portion opposite to said top shell portion in a vertical direction, a weight selector rod having a top rod end connected to said top shell portion, extending downwardly from said inner side of said top shell portion into said receiving space of said shell body, and formed with a plurality of through holes spaced apart from each other in the vertical direction, said shell body being formed with a plurality of insert holes, each of which is registered with a respective one of said through holes in said weight selector rod, and a handle connected to said outer side of said top shell portion;

a weight unit extended removably into said receiving space via said bottom shell portion of said shell body, said weight unit including a base member provided with a pair of upwardly extending positioning posts, and a plurality of weight pieces stacked on said base member, each of said weight pieces having top and bottom sides, a rod hole formed through said top and bottom sides for extension of said weight selector rod, and a pair of post holes formed through said top and bottom sides for extension of said positioning posts, respectively, said bottom side of each of said weight pieces being formed with a first slot registered with a corresponding one of said through holes in said weight selector rod and a corresponding one of said insert holes in said shell body; and an insert pin unit including an insert pin inserted removably into a selected one of said insert holes in said shell body, extending along said first slot in said bottom side of one of said weight pieces corresponding to the selected one of said insert holes, and extending removably through one of said through holes in said weight selector rod corresponding to the selected one of said insert holes such that, when said dumbbell shell unit is lifted relative to said base member, said one of said weight pieces is moved together with any other of said weight pieces disposed thereabove and said shell body away from said base member.

2. The weight-adjustable dumbbell as claimed in claim 1, wherein said inner side of said top shell portion of said shell body is formed with a pair of positioning grooves, and each of said positioning posts has a top end part removably extended into a respective one of said positioning grooves.

3. The weight-adjustable dumbbell as claimed in claim 2, wherein said top end part of each of said positioning posts is dome-shaped.

4. The weight-adjustable dumbbell as claimed in claim 1, wherein said base member includes a base block from which said positioning posts extend.

5. The weight-adjustable dumbbell as claimed in claim 1, wherein said top side of each of said weight pieces is provided with a pair of guide flanges each disposed around a respective one of said post holes, and said bottom side of each of said weight pieces is provided with a pair of guide recesses each disposed around a respective one of said post holes, said guide recesses in an upper one of said weight pieces receiving said guide flanges of a lower one of said weight pieces and guiding extension of said positioning posts through said post holes.

6. The weight-adjustable dumbbell as claimed in claim 1, wherein said insert pin unit further includes a spring-loaded tumbler provided on said insert pin.

7. The weight-adjustable dumbbell as claimed in claim 1, wherein said shell body is generally ball-shaped, and said handle has opposite ends connected to said shell body.

8. The weight-adjustable dumbbell as claimed in claim 1, wherein said top side of each of said weight pieces is formed with a second slot parallel to said first slot.

9. The weight-adjustable dumbbell as claimed in claim 1, wherein said shell body has an outer surface provided with weight indicia at positions corresponding to said insert holes.

* * * * *